United States Patent [19]

Holtz

[11] Patent Number: 5,074,422

[45] Date of Patent: Dec. 24, 1991

[54] CANTILEVER SHELVING

[76] Inventor: Jonathan J. Holtz, 592 Brook St., Garden City, N.Y. 11530

[21] Appl. No.: 585,976

[22] Filed: Sep. 21, 1990

[51] Int. Cl.[5] ..... A47F 5/00

[52] U.S. Cl. ..... 211/187; 248/243; 108/108

[58] Field of Search ..... 211/187, 90, 193; 248/243; 108/108, 107, 152

[56] References Cited

U.S. PATENT DOCUMENTS

| | | | |
|---|---|---|---|
| 2,739,777 | 3/1956 | Schoenhardt | 248/243 |
| 2,872,049 | 2/1959 | Slater | 108/108 |
| 2,941,775 | 6/1960 | Arnit | 248/243 |
| 3,263,821 | 8/1966 | Klene et al. | 248/243 X |
| 3,375,936 | 4/1968 | Kessler | 108/108 |
| 3,379,190 | 4/1968 | Leach | 108/108 X |
| 3,450,270 | 6/1969 | Brown | 248/243 X |
| 3,603,274 | 9/1971 | Ferdinand | 248/243 X |
| 3,770,135 | 11/1973 | Schild | 211/187 X |
| 4,218,058 | 8/1980 | Hilbert et al. | 248/243 X |
| 4,444,323 | 4/1984 | Travis | 248/243 X |

FOREIGN PATENT DOCUMENTS

| | | | |
|---|---|---|---|
| 0766183 | 6/1934 | France | 211/187 |
| 1068190 | 6/1954 | France | 211/187 |
| 1342714 | 9/1963 | France | 211/187 |
| 8302767 | 3/1985 | Netherlands | 248/243 |
| 0376620 | 5/1964 | Switzerland | 248/243 |
| 2181637 | 4/1987 | United Kingdom | 248/243 |

*Primary Examiner*—Robert W. Gibson, Jr.

[57] ABSTRACT

A storage device with cantilever mounted shelves using double walled support posts which in a rear wall has a four-sided slot to receive a hook on the shelf and in front wall has a three-sided slot functioning as a seat for the shelf, thus supporting the shelf in a cantilever fashion and obviating inadvertent disengagement because of the rear shelf hook which requires tilting of the shelf for its removal from the support posts.

2 Claims, 2 Drawing Sheets

CANTILEVER SHELVING

The present invention relates to a vertical array cantilever-supported shelves, and more particularly to improvements in the cantilever mounting which simplifies the construction without adversely affecting the weight supporting capacity of a shelf or complicating its attachment to its vertical support.

EXAMPLE OF THE PRIOR ART

In U.S. Pat. No. 2,739,777 issued on Mar. 27, 1956 to Schoenhardt, shelves are supported in cantilever fashion, as best shown in FIGS. 3 and 7 and duplicated herein in FIGS. 11 and 12, but the shelf structure connected to the upright supports is more complicated and significantly less stable. If the front of a shelf, for example, is inadvertently urged through an ascending pivotal transverse, it will unhook from its vertical support and, once unhooked, can then be moved, again possibly inadvertently, forward and become completely detached from its vertical support.

Broadly, it is an object of the present invention to overcome the foregoing and other shortcomings of the prior art. More particularly, it is an object to readily permit the cantilever mounting onto vertical posts or uprights of shelves wherein, after the shelves are so engaged, they are not easily inadvertently or intentionally disengaged, although intentional disengagement is not rendered too difficult.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
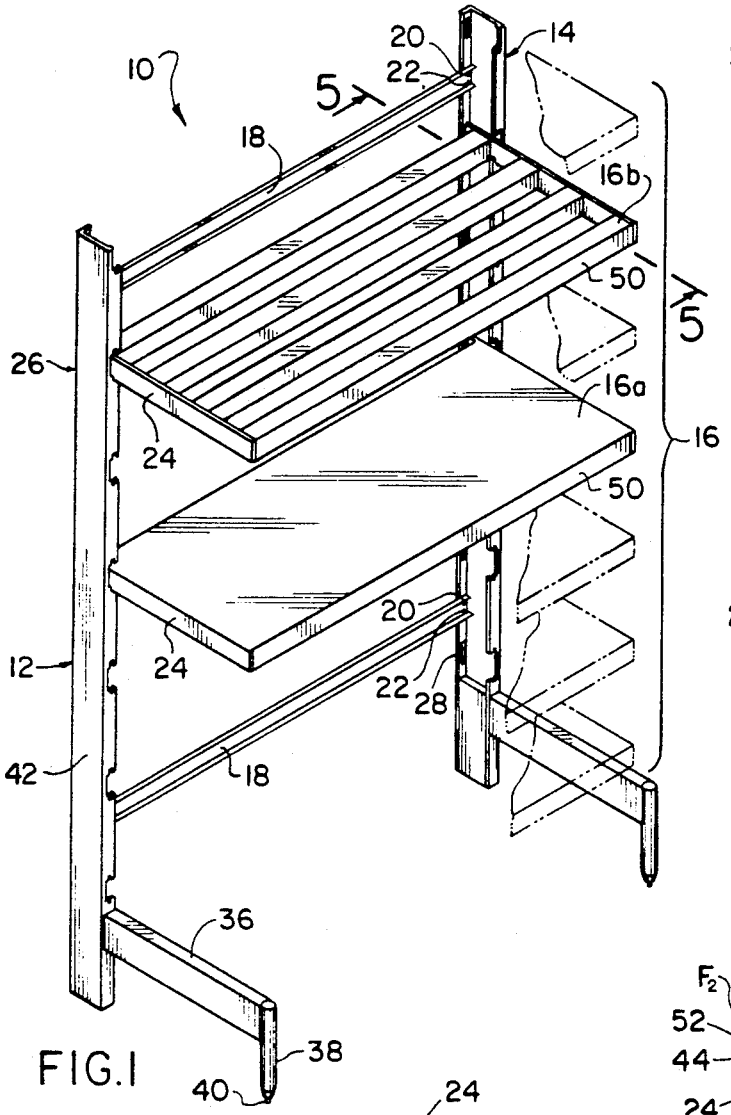
FIG. 1 is a perspective view of a shelf assembly having cantilever-supported shelves according to the present invention.

The present invention is demonstrated by a shelf assembly 10 shown in FIG. 1 which will be understood to be made of heavy duty, non-rusting aluminum, and to include a left side upright or post 12 and a right side upright or post 14 having a vertical array of cantilever-mounted shelves 16.

Figure 2:
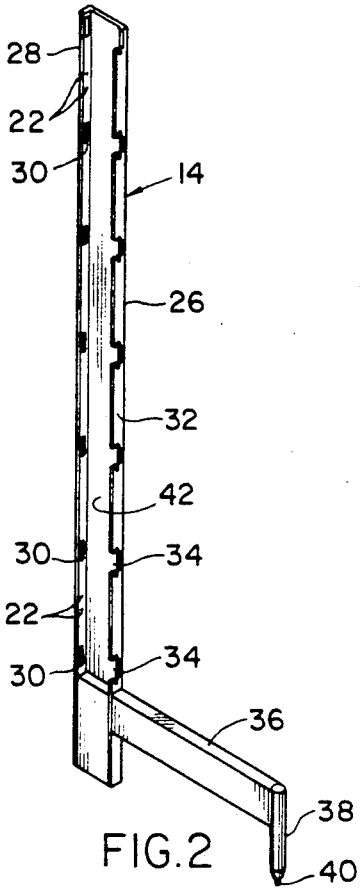
FIG. 2 is a perspective view of a support post component of the shelf assembly.
Figure 10:
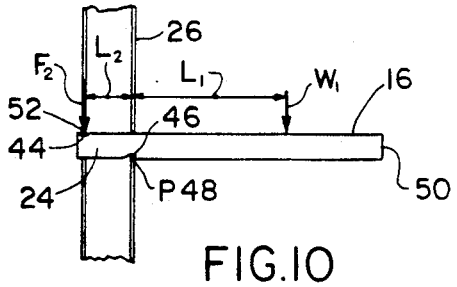
FIG. 10 is a schematic representation of FIG. 5 illustrating offsetting moments embodied in the cantilever mounting hereof.
Figure 7:
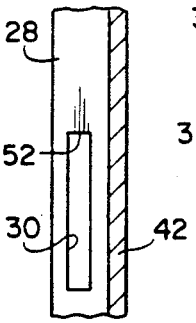
FIG. 7 is a sectional view taken along line 7—7 of FIG. 6.
Figure 8:
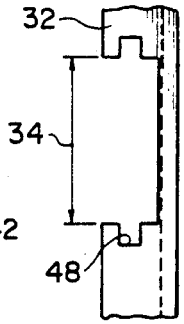
FIG. 8 is a view taken in the direction of the line 8—8 of FIG. 6.
Figure 9:
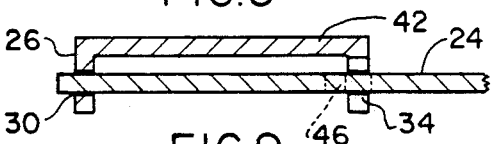
FIG. 9 is a sectional view taken along line 9—9 of FIG. 5.

Both uprights 12 and 14 are identically constructed and as best shown in FIG. 2 and using the right side upright 14 as an example, each is comprised of a vertical leg 26 that is channel or "U" shaped in cross section as more particularly shown in FIG. 9, so as to have a rear wall or flange 28, a front wall or flange 32 and a connecting wall therebetween of a prescribed distance L2 (FIG. 10). The rear flange 28 is provided with vertically spaced four sided slots 30 (FIG. 7), while the front flange 32 has similar, but three sided slots 34 of C-shape in profile (FIG. 8), each in horizontal alignment with a cooperating slot 30. Just below the lowest slot or C-shaped cutout, 34 a horizontal support arm 36 extends forward and terminates with a vertical leg 38. A lockable, adjustable screw 40, used to make upright 14 plumb, is located at the bottom of leg 38. Upright 12 is, as already noted, identical to upright 14 except that leg member 42 on vertical leg 26 faces in the opposite direction so as to be facing inboard in the shelf assembly 10.

Uprights 12 and 14 are spaced apart as shown and held in this spaced relation from each other by a pair of horizontal channel members 18. Suitable bolts 20 are used to fasten members 18 to uprights 12 and 14 when passed through appropriately placed bolt holes 22 in members 18, 12 and 14.

Figure 3:
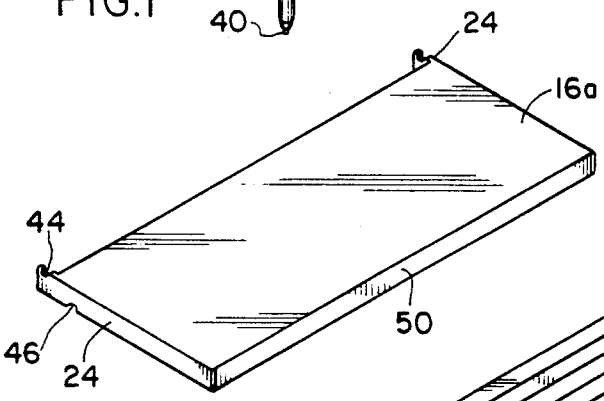
FIG. 3 is a perspective view of one embodiment of a shelf.
Figure 4:
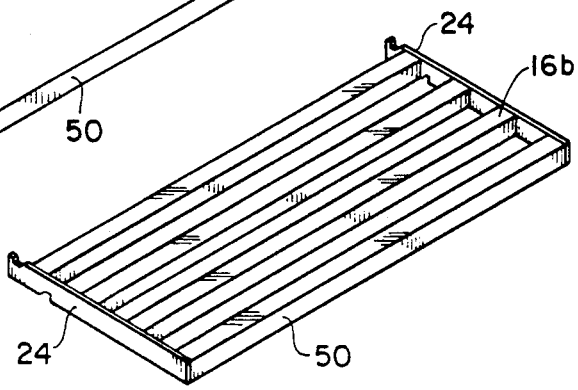
FIG. 4 is a similar perspective view of another embodiment of a shelf.

Adapted to be supported on the posts or uprights 12 and 14 are two inch thick shelves 16 made in two basic types **16*a* and 16*b*. Type 16*a* (FIG. 3) is known in the trade as a solid reinforced shelf, while shelf 16*b* (FIG. 4) is known as a tubular shelf having an open framework in its load-supporting area. Common to each type shelf is a left and right side bar 24. Bars 24** are made integral to their respective shelf by welding or other appropriate fastening techniques.

In the illustrated shelf assembly 10, shelves 16 and channel members 18 are optionally supplied in three, four and five foot widths, and each shelf 16 optionally with a depth of 18, 21 or 24 inches. Uprights 12 and 14 in a preferred embodiment are made to receive a maximum of seven evenly spaced shelves 16, spaced $9\frac{7}{8}$ inches apart, leaving a $7\frac{7}{8}$ inch clearance for product use between adjacent shelves. Shelves 16 may be either of the noted types **16*a* or 16*b***, or a combination thereof.

Figure 5:
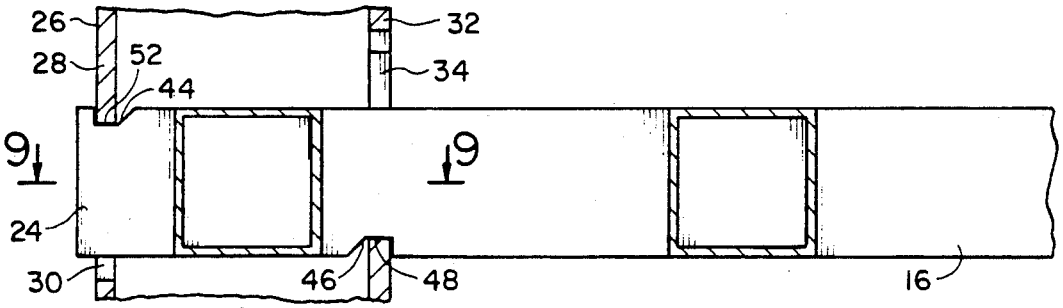
FIG. 5 is a partial sectional view taken along line 5—5 of FIG. 1.

Each of the end bars 24 on a shelf 16 has a cooperating pair of similar notches, now to be described, on its horizontal surfaces adjacent its rear end, as best shown in FIG. 5. These consist of an upper notch 44 which is hook-shaped to engage the upper edge 52 of slot 30 in flange 28 and a lower inverted V-shaped notch 46 which, in use, rests or seats on the lower edge 48 of an aligned cutout 34 in flange 32. Cutout 34 has an open vertical height slightly greater than the thickness of shelf 16 to allow the necessary clearance for facilitated assembly of a shelf to the posts or uprights 12 and 14.

More particularly, to assemble a shelf unit 10, uprights 12 and 14 are temporarily hand held while channels 18 are bolted in place with bolts 20. The assembled uprights 12 and 14 with cross members 18 are then "plumbed" with adjusting screws 40. At this stage of assembly, a selected number and type of shelves 16 are then supported in cantilever relation on the uprights 12 and 14. To achieve this, the rearmost end of the opposite side bars 24 on each shelf 16 are aligned with and partially projected through a cooperating slot 30 while the front edge 50 of shelf 16 is raised until shelf 16 assumes an approximate angle A of 15 degrees to the horizontal. The shelf is then moved rearward until notch 46 on end bars 24 engages respective seats 48 on uprights 12 and 14 Shelf 16 is then lowered and assumes a horizontally oriented position that is established when notch 44 makes hooking contact or engagement with the upper edge 52 of slot 30. As seen schematically in FIG. 10, the clockwise moments L1, W1 about a pivot point P or the location 48 equals the counterclockwise moment L2, F2. L1 is the distance from P, 48 to where the combined weight W1 of shelf 16 and the contents produce a clockwise moment, and L2 is the effective horizontal distance, between slot 52 and seat 48, at which t force F2 counterclockwise moment is produced to keep cantilever-mounted shelves 16 in equilibrium. L2 is also, of course, the width of the connecting wall between flanges 28 and 32 of each upright 12 and 14.

PRIOR ART

Figure 12:
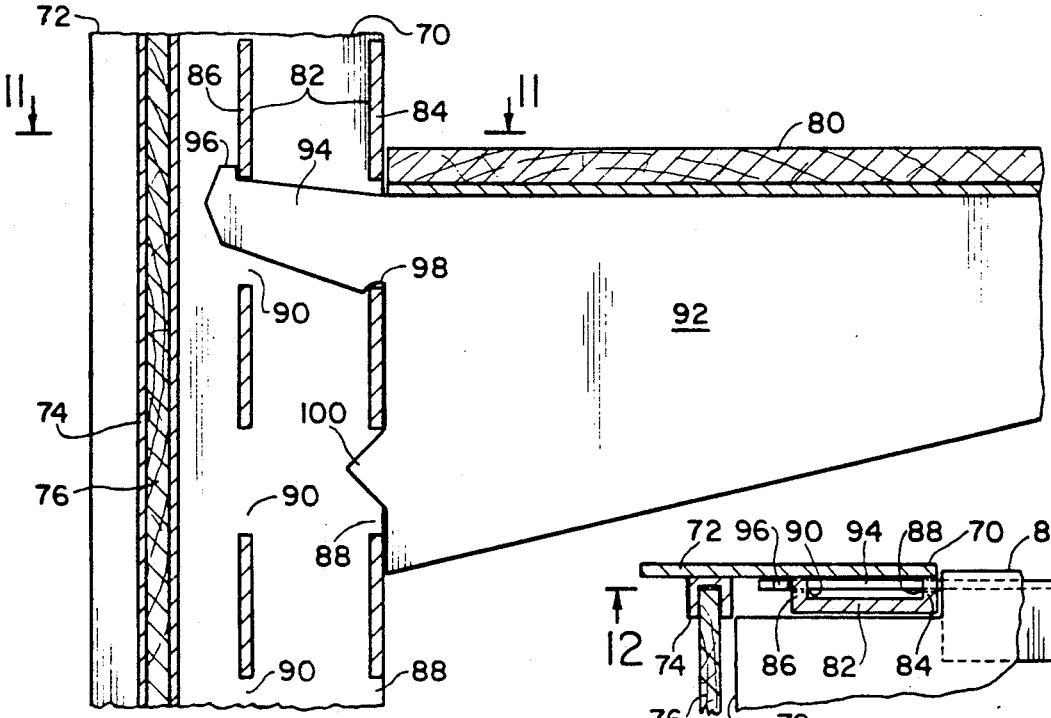
FIG.12 PRIOR ART
FIG. 12 is a sectional view taken along line 12—12 of FIG. 11.
Figure 11:
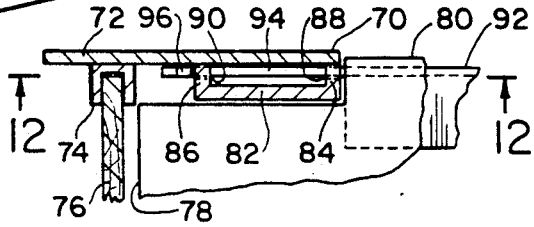
FIG.11 PRIOR ART
FIG. 11 is a sectional view taken along line 11—11 of FIG. 12 illustrating a prior art embodiment for comparison with FIG. 5.

In the prior art FIGS. 11 and 12, which are provided for comparison particularly with FIG. 5, a right side shelf upright 70 is comprised of a bar member 72 with a channel member 74 welded on the inboard side thereof. Channel 74 is used to retain a backboard 76 adjacent the rear edge 78 of a shelf 80. Additionally a channel 82, also welded to the inboard face of bar 72, has front and back legs 84 and 86 which are provided with a plurality of aligned vertically, extending slots 88 and 90 respectively. The left side upright 70' (not shown) is made as a mirror image of upright 70 to allow channels 74' and 82' to be inboard relative to bar 72'.

Attached to and supporting shelf 80 is a pair of triangular brackets 92. Each of brackets 92 has a left and right orientation and is fastened along the respective edges of shelf 80. Also, each of the brackets 92 has a securing extension 94 at its rearmost end. Extension 94 is slightly angled upward and terminates in a hooked portion 96 for engagement with the outer rear side of leg 86. The lower face of extension 94 has a downwardly opening notch portion 98 adjacent the base of bracket 92. Notch 98 is intended to fit over the bottom edge of opening 88 in leg 84. At assembly extensions 94 are guided through slots 88, 90 with shelf 80 at an angle similar to angle A previously described, and then shelf 80 is allowed to rotate to a horizontal position. Notch 98 settles about the bottom face of slot 88 (FIG. 12) while hook 96 finds its way against the upper end of slot 90 and against the rear surface of leg 86.

A nib 100 is vertically spaced downward from extension 94 along the base of bracket 92 to engage the next lower slot 88 in leg 84. Nib 100 is necessary to assure and maintain the bracket 92 in a vertical plane.

Figure 6:
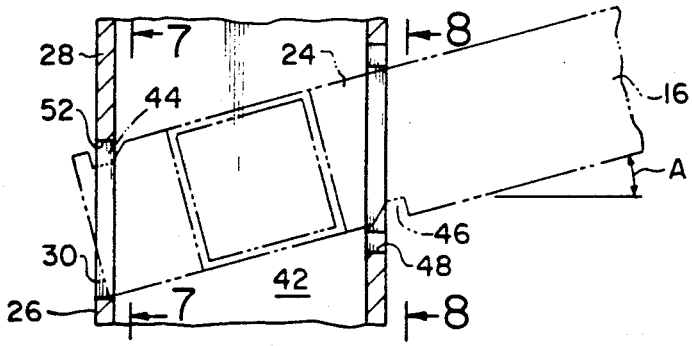
FIG. 6 is a view similar to FIG. 5 of the support post and of the shelf in phantom perspective illustrating its mounting on the post.

From the foregoing it should be readily apparent that the within inventive cantilever mounting for the shelves 16 is significantly simpler and more effective. Among other noteworthy advantages: the four sided slots 30 obviate the need for the prior art nibs 100; the arrangement of a cooperating pair of slots 30 and 34 requiring the angular shelf insertion illustrated in FIG. 6 obviate inadvertent disassembly thereof; and the inwardly facing and thus readily accessible U-shapes of the uprights 12 and 14 significantly facilitate assembly of the shelves to these uprights.

While the particular shelf assembly and shelf assembly method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A cantilever mounting for shelves comprising, in combination, a shelf support consisting of at least two vertically oriented support posts each having an inwardly facing U-shape in cross section defined by a rear wall, a front wall, and a connecting wall therebetween of a prescribed size, a plurality of four sided slots in a vertically spaced relation in said rear wall, a plurality of inwardly facing C-shaped three sided slots in said front wall each in horizontal alignment with a cooperating one of said four sided slots, and plural rectangular shaped shelves each having opposed end bars having smooth, generally planar horizontal upper and lower edges aligned with the upper and lower surfaces of the shelves, each of said side walls having adjacent its rear edge a hook means in its upper edge having an operative position projected through a cooperating one of said four sided slots in hooking relation under an upper edge of said four sided slot and, in a forwardly spaced relation from said hooking means the same distance as said size of said connecting post wall, an inverted V-shaped notch in said end bar lower edge having an operative position seated over a bottom edge of a cooperating one of, said horizontally aligned three sided post slots, whereby each said shelf so engaged in said four sided and three sided post slots extends in cantilever supported relation between and forwardly of said support posts.

2. A cantilever mounting for shelves as claimed in claim 1 wherein said shelf has said hook means and said inverted V-shaped notch in an opposite side thereof.

* * * * *